US009750978B2

(12) United States Patent
Nakashima et al.

(10) Patent No.: US 9,750,978 B2
(45) Date of Patent: Sep. 5, 2017

(54) GAIT TRAINING APPARATUS AND CONTROL METHOD THEREFOR

(71) Applicant: TOYOTA JIDOSHA KABUSHIKI KAISHA, Toyota-shi, Aichi-ken (JP)

(72) Inventors: Issei Nakashima, Toyota (JP); Hiroshi Shimada, Tajimi (JP); Masayuki Takashima, Toyota (JP); Masayuki Imaida, Ichinomiya (JP); Hitoshi Konosu, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 7 days.

(21) Appl. No.: 14/817,743

(22) Filed: Aug. 4, 2015

(65) Prior Publication Data

US 2016/0051859 A1 Feb. 25, 2016

(30) Foreign Application Priority Data

Aug. 25, 2014 (JP) ..... 2014-170599

(51) Int. Cl.
*A63B 24/00* (2006.01)
*A63B 23/04* (2006.01)
(Continued)

(52) U.S. Cl.
CPC ..... *A63B 24/0087* (2013.01); *A61H 1/0262* (2013.01); *A61H 3/00* (2013.01);
(Continued)

(58) Field of Classification Search
CPC ..... A63B 24/0087; A63B 2225/20; A63B 2225/50; A63B 24/0062; A63B 71/0622;
(Continued)

(56) References Cited

U.S. PATENT DOCUMENTS 4,724,827 A 2/1988 Schenck
5,062,632 A * 11/1991 Dalebout ..... A63B 21/015 434/247
(Continued)

FOREIGN PATENT DOCUMENTS

CN 101862255 A 10/2010
DE 202010015329 U1 2/2011
(Continued)

OTHER PUBLICATIONS

U.S. Appl. No. 14/715,124, filed May 18, 2015 in the name of Shimada et al.
(Continued)

*Primary Examiner* — Sundhara Ganesan
*Assistant Examiner* — Andrew S Lo
(74) *Attorney, Agent, or Firm* — Oliff PLC

(57) ABSTRACT

A gait training apparatus includes: a walking assistance device that is attached to a leg portion of a user and assists walking of the user; a peripheral device used for gait training of the user; a control unit that controls the walking assistance device and the peripheral device; and a switching unit that switches the control unit between a cooperative control mode for performing a cooperative control of the walking assistance device and the peripheral device based on information output from the walking assistance device, and an operation mode for controlling the peripheral device based on set operation information. When the control unit is switched to the operation mode by the switching unit, the control unit executes the control of the peripheral device even when the control unit is in a non-connected state with the walking assistance device.

7 Claims, 5 Drawing Sheets

(51) Int. Cl.

| | |
|---|---|
| ***A63B 22/02*** | (2006.01) |
| ***A63B 21/00*** | (2006.01) |
| ***A63B 71/00*** | (2006.01) |
| ***A63B 69/00*** | (2006.01) |
| ***A61H 1/02*** | (2006.01) |
| ***A61H 3/00*** | (2006.01) |

(52) U.S. Cl.
CPC ..... *A61H 3/008* (2013.01); *A63B 21/00181* (2013.01); *A63B 21/4011* (2015.10); *A63B 22/02* (2013.01); *A63B 23/04* (2013.01); *A63B 69/0028* (2013.01); *A63B 71/0054* (2013.01); *A61H 2201/0192* (2013.01); *A61H 2201/1261* (2013.01); *A61H 2201/165* (2013.01); *A61H 2201/1642* (2013.01); *A61H 2201/1664* (2013.01); *A61H 2201/1671* (2013.01); *A61H 2201/5061* (2013.01); *A61H 2203/0406* (2013.01); *A61H 2205/10* (2013.01); *A63B 2024/0093* (2013.01); *A63B 2071/0081* (2013.01)

(58) Field of Classification Search
CPC . A63B 2024/0093; A63B 22/02; A63B 24/00; A63B 24/0075; A63B 22/0605; A63B 22/0023; A63B 22/0235; A63B 22/0242; A63B 2024/0068; A63B 2071/0683; A63B 21/0058; A63B 2071/0072; A63B 2071/0081; A63B 21/4035; A63B 71/0619; A63B 23/04; A63B 2024/0096; A63B 2071/065; A63B 21/015; A63B 2225/15; A63B 22/00; A63B 21/154; A63B 2220/10; A63B 2220/16; A63B 26/003; A63B 2071/0625
USPC ..... 482/4
See application file for complete search history.

(56) References Cited

U.S. PATENT DOCUMENTS

| | | | | |
|---|---|---|---|---|
| 5,667,461 | A | 9/1997 | Hall | |
| 6,666,831 | B1 | 12/2003 | Edgerton et al. | |
| 6,676,569 | B1 * | 1/2004 | Radow | A63B 22/0235 482/4 |
| 6,796,926 | B2 | 9/2004 | Reinkensmeyer et al. | |
| 6,821,233 | B1 | 11/2004 | Colombo et al. | |
| 7,331,906 | B2 | 2/2008 | He et al. | |
| 7,494,450 | B2 | 2/2009 | Solomon | |
| 7,887,471 | B2 | 2/2011 | McSorley | |
| 7,998,040 | B2 | 8/2011 | Kram et al. | |
| 8,057,410 | B2 | 11/2011 | Angold et al. | |
| 8,095,209 | B2 * | 1/2012 | Flaherty | A61B 5/04 600/544 |
| 8,147,436 | B2 * | 4/2012 | Agrawal | A63B 21/00181 602/16 |
| 8,308,618 | B2 * | 11/2012 | Bayerlein | A61H 1/0237 482/54 |
| 8,382,646 | B2 * | 2/2013 | Schoenenberger | A61H 1/0214 434/255 |
| 8,562,548 | B2 * | 10/2013 | Shimada | A61B 5/1038 601/23 |
| 8,568,340 | B2 * | 10/2013 | Endo | A61H 1/0255 601/35 |
| 8,608,479 | B2 | 12/2013 | Liu | |
| 8,920,347 | B2 * | 12/2014 | Bayerlein | A63B 22/0235 482/54 |
| 9,314,393 | B2 * | 4/2016 | Kim | A61H 1/0255 |
| 2003/0064869 | A1 | 4/2003 | Reinkensmeyer et al. | |
| 2004/0087418 | A1 | 5/2004 | Eldridge | |
| 2004/0204294 | A2 | 10/2004 | Wilkinson et al. | |
| 2005/0101448 | A1 | 5/2005 | He et al. | |
| 2008/0242511 | A1 * | 10/2008 | Munoz | A63B 22/02 482/5 |
| 2008/0300118 | A1 | 12/2008 | Wehrell | |
| 2010/0130336 | A1 * | 5/2010 | McSorley | A63B 21/0552 482/110 |
| 2012/0071797 | A1 * | 3/2012 | Aoki | A61H 1/024 601/34 |
| 2012/0108392 | A1 * | 5/2012 | Chu | A63B 22/0292 482/4 |
| 2013/0012852 | A1 * | 1/2013 | Imaida | A61F 5/01 602/16 |
| 2013/0130866 | A1 | 5/2013 | Wehrell | |
| 2013/0225370 | A1 * | 8/2013 | Flynt | G06F 19/3481 482/4 |
| 2013/0225371 | A1 | 8/2013 | Harrer et al. | |
| 2013/0226048 | A1 * | 8/2013 | Unluhisarcikli | A61H 3/00 601/34 |
| 2014/0058299 | A1 | 2/2014 | Sankai et al. | |
| 2014/0378279 | A1 | 12/2014 | Park et al. | |
| 2015/0306440 | A1 * | 10/2015 | Bucher | A63B 71/0054 482/4 |
| 2015/0342819 | A1 | 12/2015 | Shimada et al. | |
| 2016/0051859 | A1 | 2/2016 | Nakashima et al. | |
| 2016/0136477 | A1 * | 5/2016 | Bucher | A63B 22/02 482/4 |
| 2016/0144226 | A1 * | 5/2016 | Artemiadis | A61B 5/11 482/54 |
| 2016/0150999 | A1 * | 6/2016 | Sugata | B25J 9/0006 600/587 |
| 2016/0158593 | A1 * | 6/2016 | Craig | A63B 21/4025 482/78 |

FOREIGN PATENT DOCUMENTS

| | | | |
|---|---|---|---|
| GB | 2499675 | A | 8/2013 |
| JP | H06-15658 | A | 1/1994 |
| JP | H06-15658 | U | 3/1994 |
| JP | 2005-211086 | A | 8/2005 |
| JP | 2006-006384 | A | 1/2006 |
| JP | 2007-185246 | A | 7/2007 |
| JP | 2009-183657 | A | 8/2009 |
| JP | 3155741 | U | 12/2009 |
| JP | 2012-095793 | A | 5/2012 |
| JP | 2013-543749 | A | 12/2013 |
| JP | 2015-223295 | A | 12/2015 |
| KR | 101289005 | B1 | 7/2013 |
| WO | 2012/118143 | A1 | 9/2012 |
| WO | 2013/119001 | A1 | 8/2013 |
| WO | 2014/001853 | A1 | 1/2014 |

OTHER PUBLICATIONS

Apr. 19, 2016 Office Action issued in U.S. Appl. No. 14/715,124.
Oct. 21, 2016 Office Action issued in U.S. Appl. No. 14/715,124.

* cited by examiner

GAIT TRAINING APPARATUS AND CONTROL METHOD THEREFOR

INCORPORATION BY REFERENCE

This application is based upon and claims the benefit of priority from Japanese patent application No. 2014-170599, filed on Aug. 25, 2014, the disclosure of which is incorporated herein in its entirety by reference.

BACKGROUND OF THE INVENTION

1. Field of the Invention

The present invention relates to a gait training apparatus used for gait training of a user, and a control method for the gait training apparatus.

2. Description of Related Art

A gait training apparatus including a control device that controls the belt speed of a treadmill, on which a user walks, based on sensor information of a walking assistance device attached to a leg portion of the user is known (see Japanese Unexamined Patent Application Publication No. 2012-095793).

In the gait training apparatus of the related art, the walking assistance device is integrally and inseparably connected with a peripheral device such as the treadmill. Accordingly, the walking assistance device and the peripheral device is not supposed to be used separately. Thus, when the control device is in a non-connected state in which the control device cannot obtain any information from the walking assistance device, for example, the control device unconditionally determines that a failure has occurred in the walking assistance device, and causes the peripheral device, such as the treadmill, to be stopped for the sake of safety. This causes a problem that the walking assistance device is stopped and becomes unavailable even in the case where the control device is intentionally brought into the non-connected state with the walking assistance device, for example, when the user wears a normal outfit instead of the walking assistance device.

SUMMARY OF THE INVENTION

The present invention has been made in view of the above-mentioned problem, and a main object of the present invention is to provide a gait training apparatus which is capable of discriminating whether a walking assistance device is intentionally brought into a non-connected state, or is brought into the non-connected state due to a failure in the walking assistance device, even when the gait training apparatus is in the non-connected state with the walking assistance device, and which enables a user to perform a gait training using a peripheral device, and a control method for the gait training apparatus.

In order to achieve the above-mentioned object, a first exemplary aspect of the present invention is a gait training apparatus including: a walking assistance device that is attached to a leg portion of a user and assists walking of the user; a peripheral device used for gait training of the user; a control unit that controls the walking assistance device and the peripheral device; and a switching unit that switches the control unit between a cooperative control mode for performing a cooperative control of the walking assistance device and the peripheral device based on information output from the walking assistance device, and an operation mode for controlling the peripheral device based on set operation information. When the control unit is switched to the operation mode by the switching unit, the control unit executes the control of the peripheral device even when the control unit is in a non-connected state with the walking assistance device.

In the first exemplary aspect of the present invention, when the control unit is switched to the cooperative control mode by the switching unit and is in the non-connected state with the walking assistance device, the control unit may perform the control to stop the peripheral device.

In the first exemplary aspect of the present invention, the peripheral device may include at least one of: a body weight bearing unit that pulls the user upward to bear the weight; a leg weight bearing unit that pulls at least one of the walking assistance device and the leg portion of the user upward to bear the weight; and a treadmill on which the user walks.

In the first exemplary aspect of the present invention, the peripheral device may include a leg weight bearing unit that pulls at least one of the walking assistance device and the leg portion of the user upward to bear the weight of the user; the leg weight bearing unit may include: a first pulling unit that pulls at least one of the walking assistance device and the leg portion of the user upward and forward; and a second pulling unit that pulls at least one of the walking assistance device and the leg portion of the user upward and backward; the control unit may control, in the cooperative control mode, a tensile force of each of the first and second pulling units to assist the leg portion of the user to swing forward, while bearing the weight of the walking assistance device; and the control unit may control, in the operation mode, the tensile force of each of the first and second pulling units to assist the leg portion of the user to swing forward.

In the first exemplary aspect of the present invention, the control unit may control, in the cooperative control mode, the tensile force of each of the first and second pulling units in such a manner that a resultant force of vertically-upward components of the tensile forces of the first and second pulling units is equal to a gravitational force of the walking assistance device.

In the first exemplary aspect of the present invention, the gait training apparatus may further include an alarm unit that issues an alarm to the user when the control unit is switched to the cooperative control mode by the switching unit and is in the non-connected state with the walking assistance device.

In order to achieve the above-mentioned object, a second exemplary aspect of the present invention is a control method for a gait training apparatus including: a walking assistance device that is attached to a leg portion of a user and assists walking of the user; a peripheral device used for gait training of the user; and a control unit that controls the walking assistance device, the control method including: switching a mode between a cooperative control mode for performing a cooperative control of the walking assistance device and the peripheral device based on information output from the walking assistance device, and an operation mode for controlling the peripheral device based on set operation information; and executing, when the mode is switched to the operation mode, the control of the peripheral device even when the control unit is in a non-connected state with the walking assistance device.

According to the present invention, it is possible to provide a gait training apparatus which is capable of discriminating whether a walking assistance device is intentionally brought into a non-connected state, or is brought into the non-connected state due to a failure in the walking assistance device, even when the gait training apparatus is in the non-connected state with the walking assistance device, and which enables a user to perform a gait training using a peripheral device, and a control method for the gait training apparatus.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Exemplary embodiments of the present invention will be described below with reference to the accompanying drawings.

Figure 1:
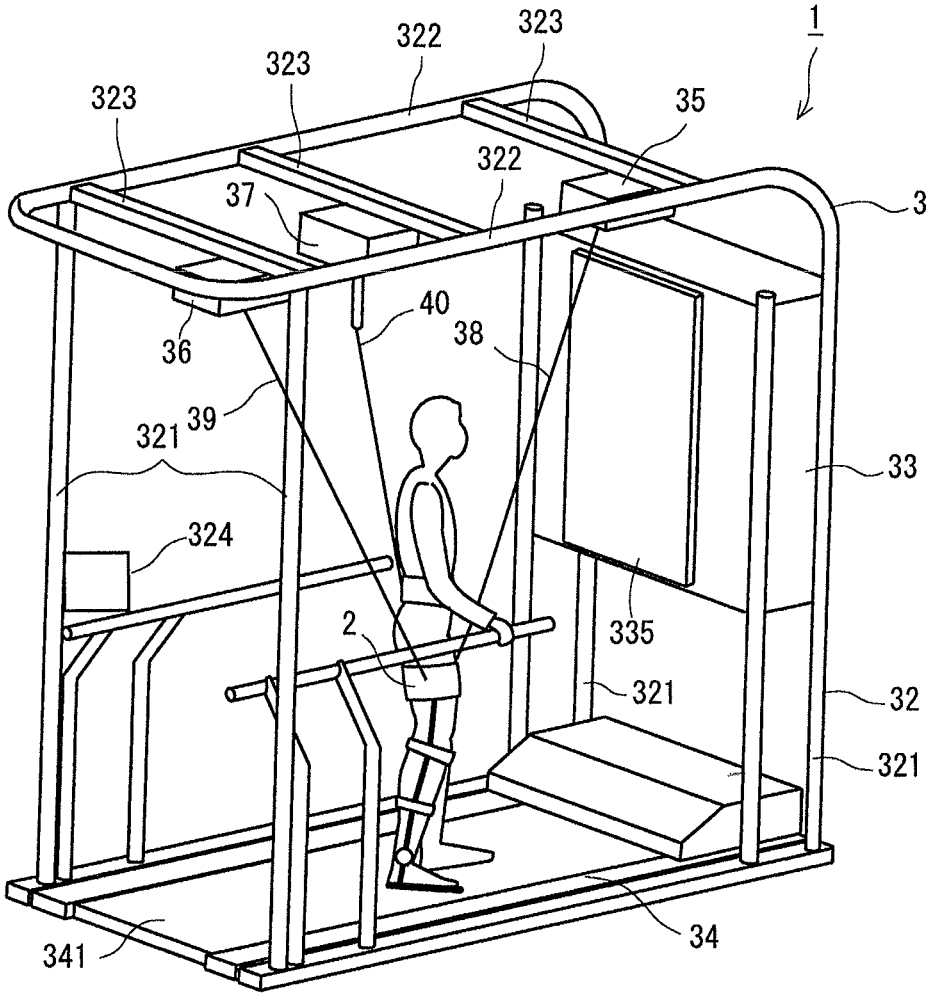
FIG. 1 is a perspective view showing a schematic structure of a gait training apparatus according to an exemplary embodiment of the present invention.

FIG. 1 is a perspective view showing a schematic structure of a gait training apparatus according to an exemplary embodiment of the present invention. A gait training apparatus 1 according to this exemplary embodiment is, for example, an apparatus used for gait training of a user such as a patient with post-stroke hemiplegia. The gait training apparatus 1 includes a walking assistance device 2 and a training device 3. The walking assistance device 2 is attached to a leg portion of the user. The training device 3 is used for gait training of the user.

Figure 2:
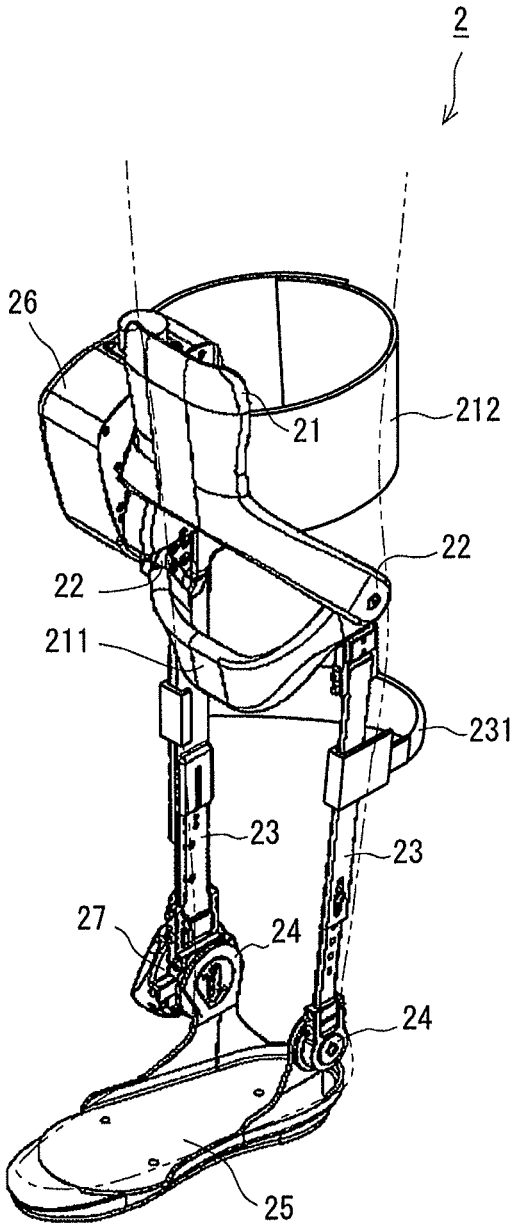
FIG. 2 is a perspective view showing a schematic structure of the walking assistance device according to an exemplary embodiment of the present invention.

The walking assistance device 2 is attached to, for example, a diseased leg of the user that performs a gait training, and assists walking of the user (FIG. 2). The walking assistance device 2 includes a thigh frame 21, shank frames 23, a foot frame 25, a motor unit 26, and an adjustment mechanism 27. The shank frames 23 are coupled to the thigh frame 21 via knee joint portions 22. The foot frame 25 is coupled to the shank frames 23 via ankle joint portions 24. The motor unit 26 rotationally drives the knee joint portions 22. The adjustment mechanism 27 adjusts the range of motion of each ankle joint portion 24.

The above-described structure of the above walking assistance device 2 is illustrated by way of example, and the structure of the above walking assistance device 2 is not limited to this. For example, the walking assistance device 2 may include a motor unit that rotationally drives the ankle joint portions 24. The walking assistance device 2 is connected to a control device 33, which is described later, through a wire, for example.

The thigh frame 21 is attached to a thigh portion of the leg portion of the user, and the shank frames 23 are each attached to a shank portion of the leg portion of the user. The thigh frame 21 is provided with a thigh brace 212 for fixing, for example, the thigh portion. The thigh brace 212 is fixed to the thigh portion by using, for example, a hook-and-loop fastener called Magic Tape (registered trademark). This prevents the walking assistance device 2 from moving in the horizontal direction or the vertical direction from the leg portion of the user.

The thigh frame 21 is provided with a horizontally-long first frame 211 that extends in the horizontal direction to connect a wire 38 of a first pulling device 35 which is described later. The shank frames 23 are provided with a horizontally-long second frame 231 that extends in the horizontal direction to connect a wire 39 of a second pulling device 36 which is described later.

The connecting portions of the first and second pulling devices 35 and 36 described above are illustrated by way example, and the connecting portions are not limited to these portions. For example, the wires 38 and 39 of the first and second pulling devices 35 and 36 may be connected to the thigh brace 212, and the pulling points of the first and second pulling devices 35 and 36 may be provided at any position on the walking assistance device 2.

The motor unit 26 rotationally drives the knee joint portions 22 in accordance with the walking motion of the user, to thereby assist walking of the user. The above-mentioned structure of the walking assistance device 2 is illustrated by way of example, and the structure of the walking assistance device 2 is not limited to this. Any walking assistance device that can be attached to a leg portion of the user to assist walking of the user can be applied.

Figure 3:
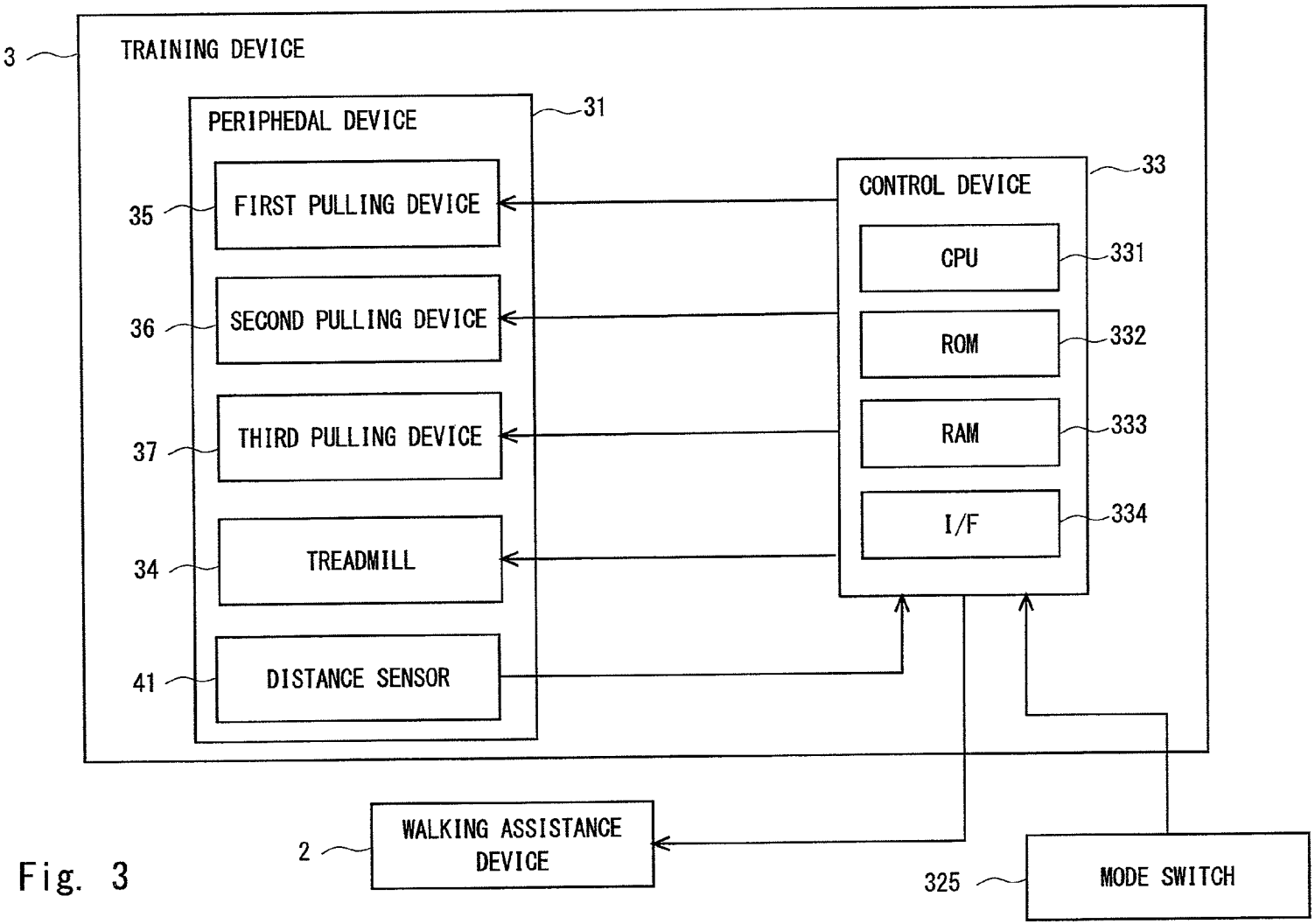
FIG. 3 is a block diagram showing a schematic system configuration of a training device according to an exemplary embodiment of the present invention.

FIG. 3 is a block diagram showing a schematic system configuration of the training device according to this exemplary embodiment. The training device 3 according to this exemplary embodiment includes a peripheral device 31, a frame body 32, and the control device 33 that controls the peripheral device 31 and the walking assistance device 2.

The frame body 32 includes two pairs of column frames 321, which are vertically arranged on a treadmill 34, a pair of front and back frames 322, which are connected to the respective column frames 321 and extend in the front-back direction, and three right and left frames 323 which are connected to the respective front and back frames 322 and extend in the horizontal direction. The frame body 32 is provided with, for example, an input device 324, such as a touch panel, to operate the peripheral device 31. The input device 324 is connected to the control device 33. The control device 33 controls the peripheral device 31 based on operation information input through the input device 324. The structure of the frame body 32 is not limited to the above-mentioned structure. Any frame structure may be used as the frame body 32, as long as the frame structure enables the first and second pulling devices 35 and 36, which are described later, to be appropriately fixed.

Further, a mode switch (a specific example of a switching unit) 325 for switching the control device 33, which is described later, between a cooperative control mode and an operation mode is provided on the touch panel of the input device 324. When the user causes the mode switch 325 to switch the control device to the cooperative control mode or the operation mode, the mode switch 325 outputs a mode signal corresponding to the switched mode to the control device 33. The control device 33 is switched between the cooperative control mode and the operation mode according to the mode signal output from the mode switch 325.

The peripheral device 31 includes the treadmill 34, first to third pulling devices 35, 36, and 37, and a distance sensor 41. The treadmill 34 causes a ring-shaped belt 341 to rotate by a motor or the like. The user stands on the belt 341 and walks in accordance with the movement of the belt 341, to thereby perform the gait training. The treadmill 34 is connected to the control device 33 through a wire or the like. The treadmill 34 changes the speed of the belt 341 according to a control signal output from the control device 33.

The first pulling device 35 is provided on the right and left frame 32 on the front side, and pulls the wire 38 upward and forward. The second pulling device 36 is provided on the right and left frame 323 on the back side, and pulls the wire 39 upward and backward.

The first and second pulling devices 35 and 36 are specific examples of a leg weight bearing unit, and are composed of, for example, a mechanism for winding or unwinding the wires 38 and 39, and a motor for driving the mechanism. One end of each of the wires 38 and 39 which are pulled by the first and second pulling devices 35 and 36, respectively, is connected to the walking assistance device 2. The first pulling device 35 pulls the walking assistance device 2 upward and forward through the wire 38. The second pulling device 36 pulls the walking assistance device 2 upward and backward through the wire 39.

Vertically upward components of tensile forces of the first and second pulling devices 35 and 36 bear the weight of the walking assistance device 2. Horizontal components of the tensile forces of the first and second pulling devices 35 and 36 assist the leg portion of the user to swing forward. This structure can reduce the load of walking of the user during the gait training. The wire 38 extends upward and forward from the walking assistance device 2 attached to the leg portion of the user, and the wire 39 extends upward and backward from the walking assistance device 2 attached to the leg portion of the user. Thus, the wires 38 and 39 do not interfere with the gait training of the user during walking.

The third pulling device 37 is provided on the right and left frame 323 located between the other right and left frames 323, and pulls a wire 40 upward. One end of the wire 40 is connected to a belt which is attached to the vicinity of a waist portion of the user. The third pulling unit 37 is a specific example of a body weight bearing unit, and is composed of, for example, a mechanism for winding or unwinding the wire 40, and a motor for driving the mechanism. The third pulling unit 37 pulls the waist portion of the user upward through the wire 40. This structure can reduce the load due to the weight of the user. The first to third pulling devices 35, 36, and 37 are each connected to the control device 33 through wires or the like.

The distance sensor 41 is, for example, a camera, an ultrasonic sensor, or a millimeter-wave sensor, and is provided on the frame body 32. The distance sensor 41 detects distance information on the user standing on the treadmill 34. The distance sensor 41 outputs the detected user distance information to the control device 33.

The control device 33 is a specific example of a control unit, and controls the tensile force of each of the first to third pulling units 35, 36, and 37, driving of the treadmill 34, and the walking assistance device 2. The control device 33 is composed of, for example, hardware centered on a microcomputer including a CPU (Central Processing Unit) 331, which performs arithmetic processing, control processing, and the like, a ROM (Read Only Memory) 332, which stores an operation program, a control program, and the like to be executed by the CPU 331, a RAM (Random Access Memory) 333, which stores various data, and an interface unit (I/F) 334 which inputs a signal from an external portion and outputs a signal to the external portion. The CPU 331, the ROM 332, the RAM 333, and the interface unit 334 are interconnected via a data bus or the like.

The control device 33 is provided with a display unit 335 that displays information such as a training instruction, a training menu, and training information (such as a walking speed and biological information). The display unit 335 is structured as, for example, a touch panel. The user can input various types of information through the display unit 335.

In the gait training apparatus of the related art, the walking assistance device is integrally and inseparably connected with a peripheral device such as the treadmill. Accordingly, the walking assistance device and the peripheral device are not supposed to be used separately. Thus, when the control device is in a non-connected state in which the control device cannot obtain any information from the walking assistance device, for example, the control device unconditionally determines that a failure has occurred in the walking assistance device, and causes the peripheral device, such as the treadmill, to be stopped for the sake of safety. This causes a problem that the walking assistance device is stopped and becomes unavailable even in the case where the control device is intentionally brought into the non-connected state with the walking assistance device, for example, when the user wears a normal outfit instead of the walking assistance device.

On the other hand, the gait training apparatus 1 according to this exemplary embodiment includes the mode switch 325 that switches the control device 33 between the cooperative control mode for performing a cooperative control of the walking assistance device 2 and the peripheral device 31 based on information output from the walking assistance device 2, and the operation mode for controlling the peripheral device 31 based on set operation information. When the control device 33 is switched to the operation mode by the mode switch 325, the control device 33 executes the control of the peripheral device 31 even when the control device 33 is in the non-connected state with the walking assistance device 2.

This structure makes it possible to discriminate whether the walking assistance device 2 is intentionally brought into the non-connected state, or is brought into the non-connected state due to a failure in the walking assistance device 2, even when the gait training apparatus is in the non-connected state with the walking assistance device 2. Accordingly, the gait training can be performed using the peripheral device 31.

As described above, the control device 33 has the cooperative control mode and the operation mode. When the control device 33 is switched to the cooperative control mode by the mode switch 325, the control device 33 controls the tensile force of each of the first and second pulling devices 35 and 36 to bear the weight of the walking assistance device 2 and assists the leg portion of the user to swing forward. The control device 33 controls the tensile force of the third pulling device 37, to thereby bear the weight of the user.

In the cooperative control mode, the control device 33 may control the tensile force of each of the first and second pulling devices 35 and 36 in such a manner that, for example, the resultant force of vertically upward components of the tensile forces of the first and second pulling devices 35 and 36 is equal to a gravitational force of the walking assistance device 2. This structure allows the user to perform the gait training more naturally without feeling the weight of the walking assistance device 2 attached to the leg portion of the user.

The control device 33 may control the tensile force of each of the first to third pulling devices 35, 36, and 37 based on, for example, the information output from the walking assistance device 2, thereby controlling the amount of weight bearing of the walking assistance device 2, the amount of assisting the leg portion to swing forward, and the amount of weight bearing of the user. More specifically, the control device 33 calculates the walking speed of the user based on, for example, the rotational angle speed of each knee joint portion 22 which is output from the walking assistance device 2. Further, the control device 33 may change the amount of weight bearing of the walking assistance device 2, the amount of assisting the leg portion to swing forward, and the amount of weight bearing of the user according to the calculated walking speed. Consequently, the load of the user can be reduced and an appropriate gait training can be performed.

When the control device 33 determines that the user is about to fall over, for example, based on the distance information output from the distance sensor 41, the control device 33 may control the tensile force of the third pulling device 37 so as to bear the weight of the user. This structure reliably prevents the user from falling over.

When the control device 33 determines that the user has started walking, for example, based on the distance information output from the distance sensor 41, the control device 33 may control the belt of the treadmill 34 to start operation.

The control device 33 may control the belt speed of the treadmill 34, for example, based on the information output from the walking assistance device 2. The control device 33 calculates the walking speed of the user based on the rotational angle speed of each knee joint portion 22 which is output from the walking assistance device 2. Further, the control device 33 may control the belt speed of the treadmill 34 to follow the calculated walking speed. This structure allows the user to start the gait training without operating the treadmill 34, which results in an improvement in convenience for the user.

In this manner, the control device 33 performs the cooperative control of the walking assistance device 2 and the peripheral device 31 such as the first to third pulling devices 35, 36, and 37 and the treadmill 34. This allows the user wearing the walking assistance device 2 to perform an effective gait training in which the load of the user is appropriately set.

In the case where the control device 33 is switched to the cooperative control mode by the mode switch 325, upon detecting the non-connected state with the walking assistance device 2, the control device 33 may control the peripheral device 31 such as the first to third pulling devices 35, 36, and 37 and the treadmill 34 so that they are stopped. In this case, there is a possibility that a failure occurs in the walking assistance device 2. Accordingly, the safety of the user can be ensured by stopping the peripheral device 31 as described above.

On the other hand, when the control device 33 is switched to the operation mode by the mode switch 325, the control device 33 controls the peripheral device 31 based on the set operation information.

When the control device 33 is switched to the operation mode, the control device 33 controls the first to third pulling devices 35, 36, and 37 and the treadmill 34, for example, based on the operation information set through the input device 324. At this time, the wires 38 and 39 of the first and second pulling devices 35 and 36 are connected to a normal outfit attached to the leg portion of the user.

The control device 33 controls the tensile force of each of the first and second pulling devices 35 and 36, for example, to thereby assist the leg portion of the user to swing forward. When the user is wearing the walking assistance device 2, the weight of the walking assistance device 2 affects the walking motion of the user. Accordingly, as described above, the control device 33 performs both the control for bearing the weight of the walking assistance device 2 and the control for assisting the leg portion of the user to swing forward, in parallel, in the cooperative control mode. On the other hand, when the user is wearing a normal outfit, the weight of the outfit has little effect on the walking motion of the user. Accordingly, the control device 33 controls the tensile force of each of the first and second pulling devices 35 and 36 in the operation mode, and mainly performs the control for assisting the leg portion of the user to swing forward.

Furthermore, the user can manually operate the tensile force of each of the first to third pulling devices 35, 36, and 37 and the belt speed, belt inclination, and the like of the treadmill 34, by appropriately changing the operation information through the input device 324. Thus, even when the user is not wearing the walking assistance device 2, the control device 33 can be switched to the operation mode and the user can perform an effective gait training by using the peripheral device 31.

When the control device 33 is switched to the operation mode by the mode switch 325, the control device 33 executes the control of the tensile force of each of the first to third pulling devices 35, 36, and 37 and the peripheral device 31 such as the treadmill 34, even when the control device 33 is in the non-connected state with the walking assistance device 2. This is because it is obvious that when the control device 33 is switched to the operation mode by the mode switch 325, the user has intentionally brought the control device 33 into the non-connected state with the walking assistance device 2 and no failure has occurred in the walking assistance device 2. Therefore, the control device 33 executes the control of the peripheral device 31 even when the control device 33 is in the non-connected state with the walking assistance device 2.

Figure 4:
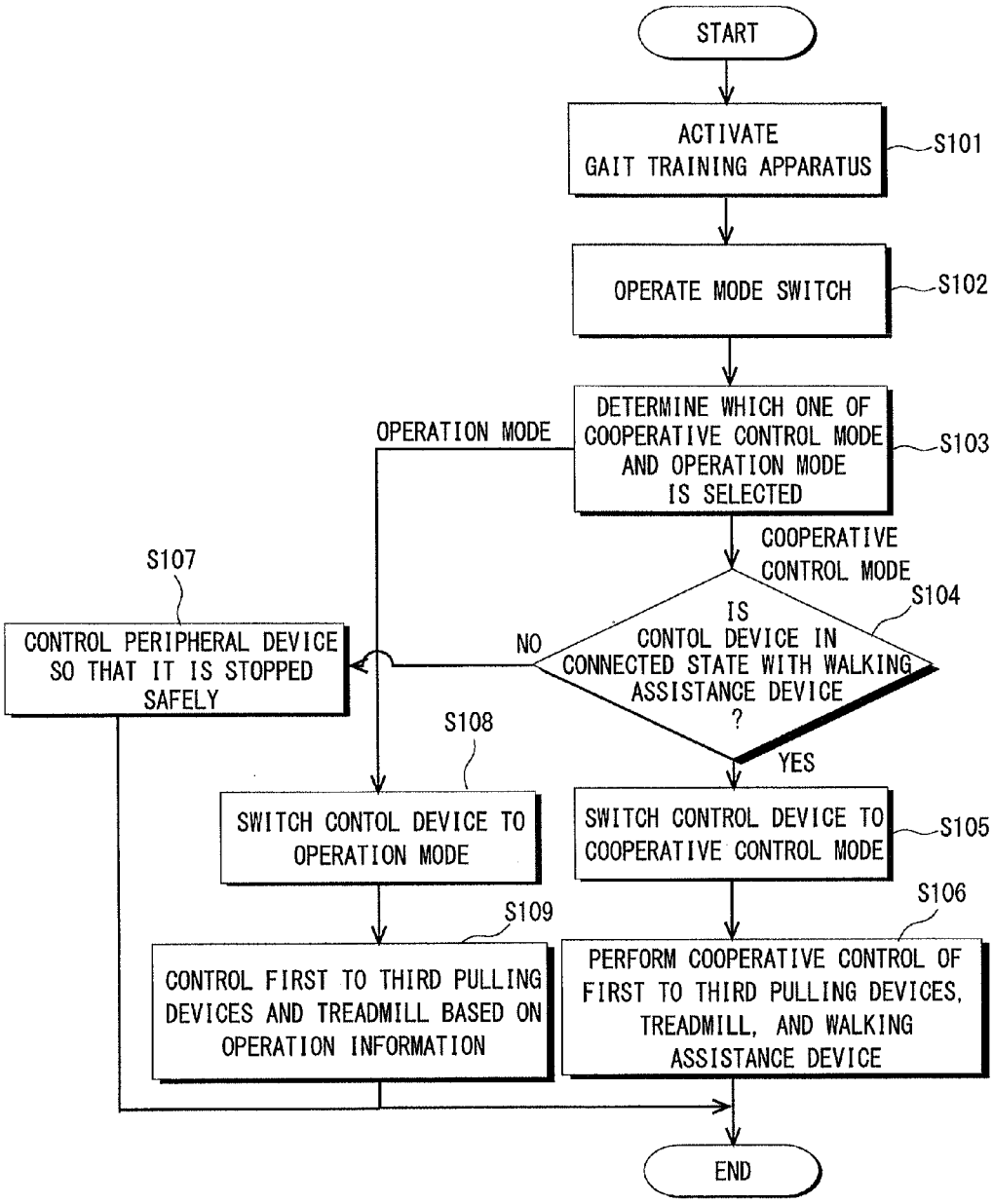
FIG. 4 is a flowchart showing a control process flow of the gait training apparatus according to an exemplary embodiment of the present invention.

FIG. 4 is a flowchart showing an example of a control process flow of the gait training apparatus according to this exemplary embodiment. When the gait training apparatus 1 is activated (step S101), the user operates the mode switch 325 on the touch panel of the input device 324, and selects one of the cooperative control mode and the operation mode (step S102).

The control device 33 determines which one of the cooperative control mode and the selection mode is selected based on the mode signal output from the mode switch 325 (step S103). Upon determining that the cooperative control mode is selected, the control device 33 determines whether or not the control device 33 is in the connected state with the walking assistance device 2 (step S104).

Upon determining that the control device 33 is in the connected state with the walking assistance device 2 (YES in step S104), the control device 33 is switched to the cooperative control mode (step S105). In the cooperative control mode, the control device 33 performs the cooperative control of the first to third pulling devices 35, 36, and 37, the treadmill 34, and the walking assistance device 2 (step S106).

On the other hand, upon determining that the control device 33 is in the non-connected state with the walking assistance device 2 (NO in step S104), the control device 33 determines that an abnormality, such as a failure in the walking assistance device 2, has occurred, and controls the peripheral device 31 such as the first to third pulling devices 35, 36, and 37 and the treadmill 34 so that they are stopped safely (step S107). Thus, when an abnormality occurs in the walking assistance device 2, the peripheral device 31 can be stopped safely, thereby making it possible to improve the safety of the user.

Upon determining that the operation mode is selected, the control device 33 is switched to the operation mode (step S108). In the operation mode, the control device 33 controls the first to third pulling devices 35, 36, and 37 and the treadmill 34 based on the operation information set through the touch panel of the input device 324 (step S109).

In this manner, when the control device 33 is switched to the operation mode by the mode switch 325, the control device 33 executes the control of the peripheral device 31 even when the control device 22 is in the non-connected state with the walking assistance device 2. This structure can provide a solution to the problem that the peripheral device 31 is stopped and becomes unavailable even in the case where the control device 33 is intentionally brought into the non-connected state with the walking assistance device 2, for example, when the user wears a normal outfit instead of the walking assistance device 2.

In the above-described control flow, the control device 33 is switched to the cooperative control mode and the operation mode by the mode switch 325 immediately after the gait training apparatus 1 is activated. However, the switching timing is not limited to this. The control device 33 can be switched to the cooperative control mode and the operation mode at any timing. The control device 33 controls the peripheral device 31 at any timing in the operation mode, even when the non-connected state with the walking assistance device 2 is detected. Further, when the control device 33 detects the non-connected state with the walking assistance device 2 at any timing in the cooperative control mode, the control device 33 controls the peripheral device 31 so that it is stopped safely.

As described above, the gait training apparatus 1 according to this exemplary embodiment includes the mode switch 325 that switches the control device 33 between the cooperative control mode for performing the cooperative control of the walking assistance device 2 and the peripheral device 31 based on the information output from the walking assistance device 2, and the operation mode for controlling the peripheral device 31 based on the set operation information. Further, when the control device 33 is switched to the operation mode by the mode switch 325, the control device 33 executes the control of the peripheral device 31 even when the control device 33 is in the non-connected state with the walking assistance device 2. This structure makes it possible to discriminate whether the walking assistance device 2 is intentionally brought into the non-connected state, or is brought into the non-connected state due to an abnormality in the walking assistance device 2, even when the gait training apparatus is in the non-connected state with the walking assistance device 2. This enables the user to perform the gait training using the peripheral device 31.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

For example, in the above exemplary embodiment, the control device 33 is connected to the peripheral device 31, such as the first, second, and third pulling devices 35, 36, and 37 and the treadmill 34, and the walking assistance device 2 through wires, but these devices may be connected wirelessly. In this case, the control device 33 detects the connected state with the walking assistance device 2, for example, when a communication connection is established between the control device 33 and the walking assistance device 2.

Figure 5:
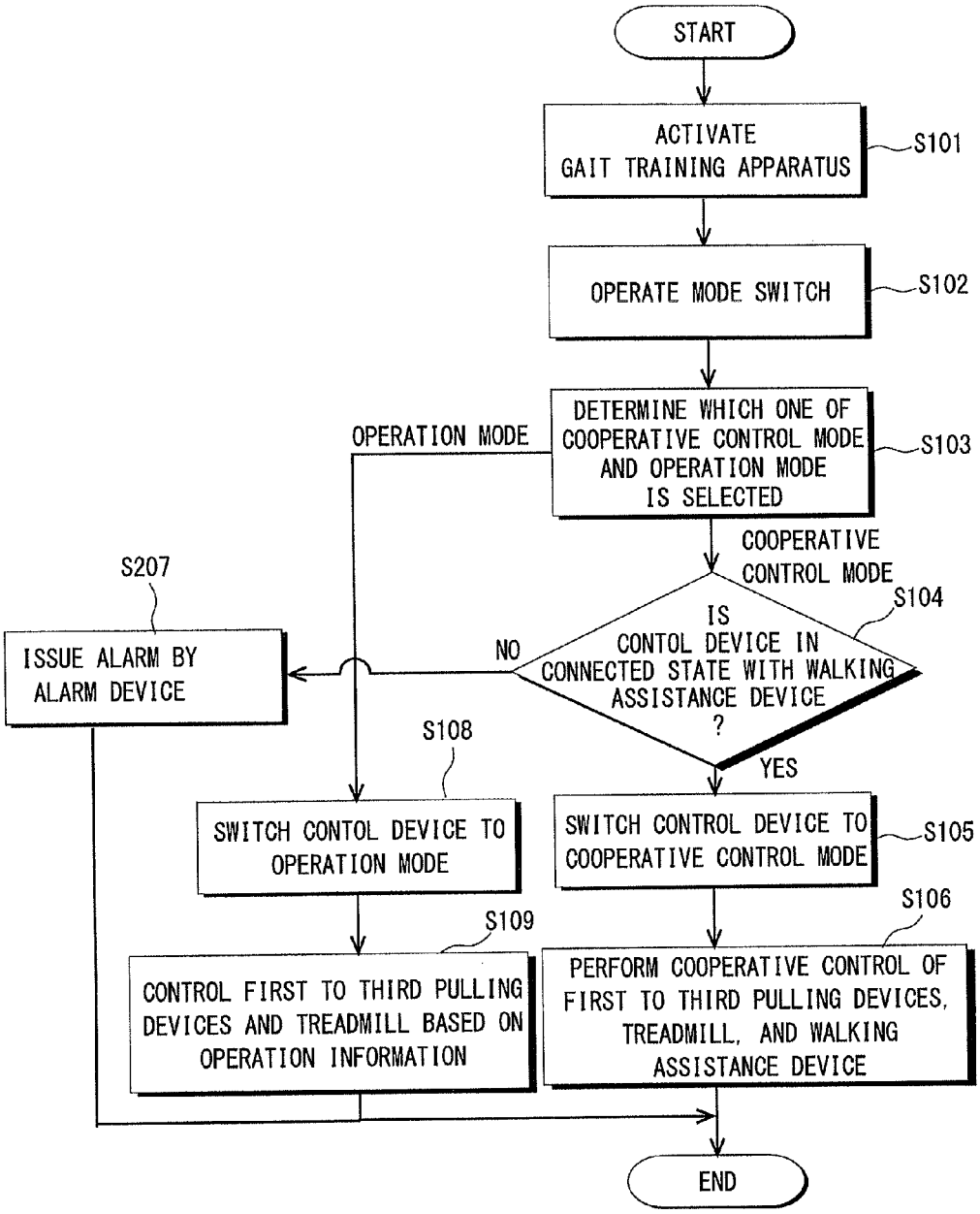
FIG. 5 is a flowchart showing a control process flow of the gait training apparatus according to another exemplary embodiment of the present invention.

In the above exemplary embodiment, when the control device 33 determines that the control device 33 is in the non-connected state with the walking assistance device 2, the control device 33 controls the peripheral device 31 so that it is stopped safely (S107 in FIG. 4). However, the operation of the control device 33 is not limited to this. The control device 33 may issue an alarm to the user by using, for example, an alarm device (S207 in FIG. 5). Furthermore, the operation of issuing an alarm and the control for causing the peripheral device 31 to stop safely may be performed in combination. Examples of the alarm device include a lighting device, which causes an warning lamp to light up or blink, a display device, which displays an alarm, a sound output device which outputs an alarm sound, and a communication device which transmits an alarm to a third party such as a training administrator.

In the above exemplary embodiment, the peripheral device 31 includes the first to third pulling devices 35, 36, and 37, the treadmill 34, and the distance sensor 41, but the structure of the peripheral device 31 is not limited to this. The peripheral device 31 may include any combination of the first to third pulling devices 35, 36, and 37, the treadmill 34, and the distance sensor 41.

In the above exemplary embodiment, the first and second pulling devices 35 and 36 are structured to pull the wires 38 and 39, respectively, which are each connected to the walking assistance device 2, to bear the weight of the walking assistance device 2. However, the structure of the first and second pulling devices 35 and 36 is not limited to this. The first and second pulling devices 35 and 36 may be structured so as to bear the weight of the walking assistance device 2 through the wires 38 and 39 which are each connected to the leg portion of the user through an outfit, a belt, or the like.

In the above exemplary embodiment, the first pulling device 35 is structured so as to pull the walking assistance device 2 upward and forward through the wire 38 and the second pulling device 36 is structured so as to pull the walking assistance device 2 upward and backward through the wire 39. However, the structures of the first and second pulling devices 35 and 36 are not limited to these structures. For example, the first pulling device 35 may be structured so as to pull the walking assistance device 2 forward through the wire 38 and the second pulling device 36 may be structured so as to pull the walking assistance device 2 backward through the wire 39.

In the above exemplary embodiment, the training device 3 may not include the frame body 32. In this case, the first to third pulling devices 35, 36, and 37 may be provided on, for example, a wall surface or a ceiling.

In the above exemplary embodiment, the peripheral device 31 includes the treadmill 34, the first to third pulling devices 35, 36, and 37, and the distance sensor 41. However, the peripheral device 31 may include other devices used for gait training of the user, and the devices may be arbitrarily combined. For example, the peripheral device 31 may include the display unit 335. In the cooperative control mode, the control device 33 may perform a cooperative control of the first to third pulling devices 35, 36, and 37, the treadmill 34, the display unit 335, and the walking assistance device 2.

What is claimed is:

1. A gait training apparatus comprising:

a walking assistance device configured to be attached to a leg portion of a user and to assist walking of the user;

a peripheral device configured to be used for gait training of the user;

a control unit that controls the walking assistance device and the peripheral device; and a switch that switches the control unit between a cooperative control mode for performing a cooperative control of the walking assistance device and the peripheral device based on information output from the walking assistance device, and an operation mode for controlling the peripheral device based on set operation information, wherein when the control unit is switched to the cooperative control mode by the switch and is in a non-connected state with the walking assistance device, the control unit performs at least one of control to stop the peripheral device and control to issue an alarm to the user, and wherein when the control unit is switched to the operation mode by the switch, the control unit executes the control of the peripheral device even when the control unit is in the non-connected state with the walking assistance device.

2. The gait training apparatus according to claim 1, wherein when the control unit is switched to the cooperative control mode by the switch and is in the non-connected state with the walking assistance device, the control unit performs control to stop the peripheral device.

3. The gait training apparatus according to claim 1, wherein the peripheral device includes at least one of: a body weight bearing unit configured to attach to a user and to pull the user upward to bear the weight of the user when attached to the user; a leg weight bearing unit configured to attach to at least one of the walking assistance device and the leg portion of the user and to pull at least one of the walking assistance device and the leg portion of the user upward to bear the weight of the leg of the user when attached to at least one of the walking assistance device and the leg portion of the user; and a treadmill on which the user walks.

4. The gait training apparatus according to claim 1, wherein the peripheral device includes a leg weight bearing unit configured to attach to at least one of the walking assistance device and the leg portion of the user and to pull at least one of the walking assistance device and the leg portion of the user upward to bear the weight of the leg of the user when attached to at least one of the walking assistance device and the leg portion of the user, the leg weight bearing unit comprises:

a first pulling unit configured to attach to at least one of the walking assistance device and the leg portion of the user and to pull at least one of the walking assistance device and the leg portion of the user upward and forward when attached to at least one of the walking assistance device and the leg portion of the user; and a second pulling unit configured to attach to at least one of the walking assistance device and the leg portion of the user and to pull at least one of the walking assistance device and the leg portion of the user upward and backward when attached to at least one of the walking assistance device and the leg portion of the user, the control unit controls, in the cooperative control mode, a tensile force of each of the first and second pulling units to assist the leg portion of the user to swing forward, while bearing the weight of the walking assistance device when the first and second pulling units are attached to at least one of the walking assistance device and the leg portion of the user, and the control unit controls, in the operation mode, the tensile force of each of the first and second pulling units to assist the leg portion of the user to swing forward when attached to at least one of the walking assistance device and the leg portion of the user.

5. The gait training apparatus according to claim 4, wherein the control unit controls, in the cooperative control mode, the tensile force of each of the first and second pulling units in such a manner that a resultant force of vertically-upward components of the tensile forces of the first and second pulling units is equal to a gravitational force of the walking assistance device when the first and second pulling units are attached to at least one of the walking assistance device and the leg portion of the user.

6. The gait training apparatus according to claim 1, further comprising an alarm unit that issues an alarm to the user when the control unit is switched to the cooperative control mode by the switch and is in the non-connected state with the walking assistance device.

7. A control method for a gait training apparatus, the gait training apparatus comprising a walking assistance device configured to be attached to a leg portion of a user and to assist walking of the user, a peripheral device configured to be used for gait training of the user, and a control unit that controls the walking assistance device, the control method comprising:

switching a mode of the control unit between a cooperative control mode for performing a cooperative control of the walking assistance device and the peripheral device based on information output from the walking assistance device, and an operation mode for controlling the peripheral device based on set operation information;

stopping the peripheral device or issuing an alarm by operation of the control unit when the control unit is switched to the cooperative control mode and is in the non-connected state with the walking assistance device, and executing, when the mode is switched to the operation mode, the control of the peripheral device by the control unit even when the control unit is in a non-connected state with the walking assistance device.

* * * * *